US010174590B2

(12) United States Patent
Kellner

(10) Patent No.: US 10,174,590 B2
(45) Date of Patent: Jan. 8, 2019

(54) TOE VALVE

(71) Applicant: TEAM OIL TOOLS, LP, The Woodlands, TX (US)

(72) Inventor: Justin Kellner, The Woodlands, TX (US)

(73) Assignee: INNOVEX DOWNHOLE SOLUTIONS, INC., The Woodlands, TX (US)

( * ) Notice: Subject to any disclaimer, the term of this patent is extended or adjusted under 35 U.S.C. 154(b) by 337 days.

(21) Appl. No.: 15/053,728

(22) Filed: Feb. 25, 2016

(65) Prior Publication Data

US 2016/0177667 A1 Jun. 23, 2016

(51) Int. Cl.

| | |
|---|---|
| ***E21B 34/12*** | (2006.01) |
| ***E21B 34/10*** | (2006.01) |
| ***E21B 34/14*** | (2006.01) |
| *E21B 34/00* | (2006.01) |

(52) U.S. Cl.

CPC ..... *E21B 34/103* (2013.01); *E21B 34/12* (2013.01); *E21B 34/14* (2013.01); *E21B 2034/007* (2013.01)

(58) Field of Classification Search

CPC ..... E21B 34/12; E21B 2034/007

See application file for complete search history.

(56) References Cited

U.S. PATENT DOCUMENTS

| | | | | |
|---|---|---|---|---|
| 8,267,178 | B1 | 9/2012 | Sommers et al. | |
| 8,863,853 | B1 | 10/2014 | Harris et al. | |
| 2012/0042966 | A1* | 2/2012 | Ross | E21B 34/103 137/517 |

OTHER PUBLICATIONS

Kenneth J. Anton et al., "Method and Apparatus for Smooth Bore Toe Valve", U.S. Appl. No. 13/924,828, filed Jun. 24, 2013.

Team Oil Tools, "ORIO Toe Valve", http://www.teamoiltools.com/content/documents/product_data_sheets/01_T-Frac_System/ORIO_toe_valve_BE_web.pdf, Retrieved from the internet Dec. 1, 2014, 1 page.

Michael J. Harris et al., "Method and Apparatus for Actuating a Downhole Tool", U.S. Appl. No. 14/073,706, filed Nov. 6, 2013.

Kenneth J. Anton et al., "Toe Valve", U.S. Appl. No. 14/569,927, filed Dec. 15, 2014.

* cited by examiner

*Primary Examiner* — Giovanna C. Wright

(74) *Attorney, Agent, or Firm* — MH2 Technology Law Group LLP

(57) ABSTRACT

An actuator for a downhole tool includes first, second, and third sleeves. The first sleeve obstructs a first port in a body of the downhole tool when the first sleeve is in a first position. The third sleeve obstructs a second port in the body when the third sleeve is in a first position, and the second and third sleeves are in one-way engagement with one another. A biasing member is positioned between the first sleeve and the third sleeve. The first sleeve is configured to move from the first position and toward the third sleeve in response a pressure communicated through the first port. When the pressure is reduced after the first sleeve is moved toward the third sleeve, the biasing member forces the first sleeve back toward the first position, which causes the third sleeve to permit fluid communication through the second port.

28 Claims, 6 Drawing Sheets

TOE VALVE

BACKGROUND

A toe valve may be positioned at the bottom of a cemented casing completion in a horizontal or deviated wellbore. The toe valve may include a sliding sleeve that moves from a first, closed position to a second, open position. When the sliding sleeve is in the open position, a path of fluid communication is established from a bore in the toe valve to the exterior of the toe valve for circulation. This may occur prior to treatment operations in the wellbore.

Once the toe valve is in the desired location in the wellbore, the integrity of the casing may be tested. This may be accomplished by increasing the pressure of the fluid in the wellbore to a first level (e.g., higher than the pressure required to hydraulically fracture the surrounding formation). Subsequent to the integrity of the casing being confirmed, the sliding sleeve may be moved from the closed position to the open position. This may be accomplished by increasing the pressure of the fluid in the wellbore to a second level. The second level is higher than the first level to avoid the sliding sleeve inadvertently moving to the open position during testing. However, because the pressure needed to open the toe valve exceeds the pressure at which the casing integrity is tested, opening the toe valve may risk damaging the casing.

SUMMARY

An actuator for a downhole tool is disclosed. The actuator includes a first sleeve, a second sleeve, and a third sleeve. The first sleeve obstructs a first port in a body of the downhole tool when the first sleeve is in a first position. The second sleeve is movable with the first sleeve and extends axially therefrom. The third sleeve obstructs a second port in the body when the third sleeve is in a first position, and the second and third sleeves are in one-way engagement with one another. A biasing member is positioned between the first sleeve and the third sleeve, such that movement of the first sleeve toward the third sleeve compresses the biasing member. The first sleeve is configured to move from the first position and toward the third sleeve in response a pressure communicated through the first port. When the pressure is reduced after the first sleeve is moved toward the third sleeve, the biasing member forces the first sleeve back toward the first position, which causes the third sleeve to permit fluid communication through the second port.

A downhole tool is also disclosed. The downhole tool includes an inner housing having a bore extending axially-therethrough, a first opening extending radially-therethrough, and a second opening extending radially-therethrough. The first and second openings are axially-offset from one another. An outer housing is positioned radially-outward from the inner housing such that an annulus is disposed between the inner and outer housings. The outer housing has a third opening extending radially-therethrough. First, second, third, and fourth sleeves are positioned in the annulus. The second sleeve is movable with the first sleeve and extends axially therefrom. The third sleeve is axially-offset from the first sleeve, and the third sleeve prevents fluid flow through the second opening when the third sleeve is in a first position. The fourth sleeve is axially-offset from the third sleeve, and the fourth sleeve prevents fluid flow through the third opening when the fourth sleeve is in a first position. The first and second sleeves move together within the annulus such that the second sleeve engages the third sleeve when a pressure of a fluid in the bore is increased to a first level. The first, second, and third sleeves move together such that the third sleeve moves into a second position that allows fluid flow through the second opening when the pressure of the fluid in the bore is decreased to a second level. The fourth sleeve moves into a second position that allows fluid flow through the third opening as the pressure of the fluid in the bore is decreasing from the first level to the second level or when the pressure of the fluid in the bore is increased from the second level to a third level.

A method for operating a downhole tool is also disclosed. The method includes running the downhole tool into a wellbore. The downhole tool defines a bore extending axially-therethrough, an annulus positioned radially-outward from the bore, a first opening that provides a path of fluid communication radially-between the bore and the annulus, a second opening that provides a path of fluid communication radially-between the bore and the annulus, and a third opening that provides a path of communication from the annulus to an exterior of the downhole tool. A pressure of a fluid in the bore is increased to a first level. The first level of pressure is communicated through the first opening and exerts a force on a first sleeve in the annulus that causes the first sleeve and a second sleeve to move from a first position to a second position. The pressure of the fluid in the bore is then decreased to a second level after the first and second sleeves move to the second position, thereby causing a third sleeve in the annulus to move from a first position where the third sleeve prevents fluid flow through the second opening to a second position where the third sleeve allows fluid flow through the second opening.

In another embodiment, the method includes positioning a downhole tool in a first state into a wellbore. The downhole tool is closed in the first state such that fluid communication is not permitted radially-through the downhole tool. The pressure of a fluid in a bore of the downhole tool is then increased to a first level. Increasing the pressure to the first level causes the downhole tool to actuate from the first state to a second state. The downhole tool remains closed in the second state. The pressure of the fluid in the bore is then decreased to a second level after increasing the pressure to the first level. Decreasing the pressure to the second level causes the downhole tool to actuate from the second state to a third state. The downhole tool remains closed in the third state. The pressure of the fluid in the bore is then adjusted to a third level after decreasing the pressure to the second level. Adjusting the pressure to the third level causes the downhole tool to actuate from the third state to a fourth state. The downhole tool is open in the fourth state, such that fluid communication radially through the downhole tool is permitted.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
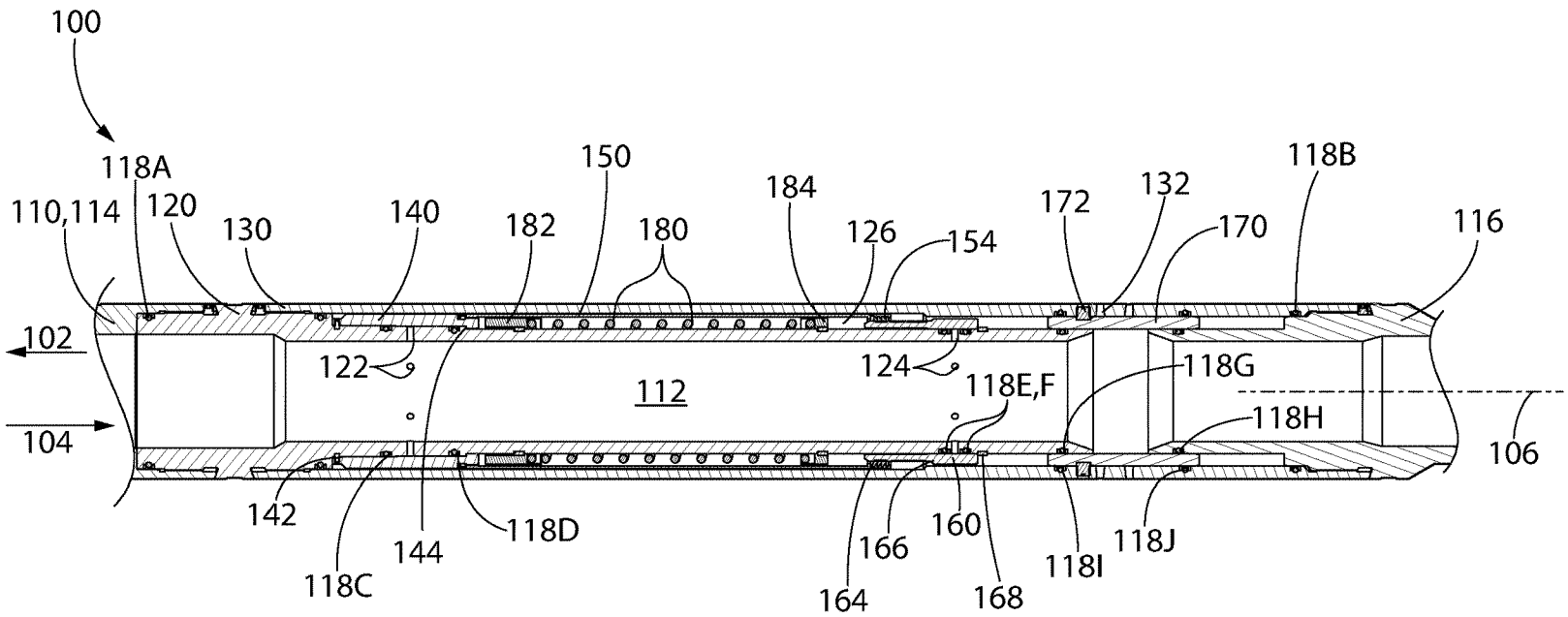
FIG. 1 illustrates a cross-sectional side view of a downhole tool in a first, run-in state, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool, such as a toe valve, that includes a plurality of sleeves and a ring (e.g., a ratchet ring). Together, the sleeves and the ring may cooperate to allow the downhole tool to actuate from a first state when the downhole tool is run into the wellbore to a second state when the wellbore is being pressure tested. The downhole tool may then actuate into a third state as the pressure in the wellbore decreases after the pressure testing. The downhole tool may then actuate into a fourth state when the pressure is increased again or while the pressure decreases in the wellbore after the pressure testing, and a path of fluid communication from an interior axial bore in the downhole tool to an exterior of the downhole tool may exist when the downhole tool is in the fourth state. The downhole tool may actuate from the third state to the fourth state in response to a pressure that is less than the pressure that causes the downhole tool to actuate from the first state to the second state.

Turning to the specific, illustrated embodiments, FIG. 1 illustrates a cross-sectional side view of a downhole tool 100 in a first, run-in state, according to an embodiment. The downhole tool 100 may be any tool that is designed to be run into a wellbore and circulate a fluid in the wellbore. As shown, the downhole tool 100 may be a toe valve. The downhole tool 100 may include a body 110 having a bore 112 formed at least partially therethrough. The body 110 may be one component, or the body 110 may include two or more components coupled together. As shown, the body 110 includes a first or "upper" sub 114 and a second or "lower" sub 116. The upper and lower subs 114, 116 may be axially-offset from one another (e.g., as proceeding along a central longitudinal axis 106 of the downhole tool 100). The body 110 may also include an "inner" housing 120 and an "outer" housing 130 that are each positioned at least partially axially-between the upper and lower subs 114, 116. At least a portion of the inner housing 120 may be positioned radially-inward from the outer housing 130 such that an annulus 126 is formed therebetween. As shown, the inner housing 120 may be coupled to the upper sub 114, and the outer housing 130 may be coupled to the lower sub 116.

A seal 118A may be positioned radially-between the upper sub 114 and the inner housing 120. Another seal 118B may be positioned radially-between the lower sub 116 and the outer housing 130. The seals 118A, 118B may be made of a polymer or elastomer (e.g., rubber) and designed to prevent fluid flow between adjacent components. In at least one embodiment, the seals 118A, 118B may be O-rings.

The inner housing 120 may have one or more first openings 122 formed radially-therethrough. A path of fluid communication may exist from the bore 112, through the first openings 122, and into a portion of the annulus 126. The inner housing 120 may also have one or more second openings 124 formed radially-therethrough. The second openings 124 may be axially-offset from the first openings 122. As shown, the second openings 124 may be positioned below or downhole from the first openings 122. A path of fluid communication may exist from the bore 112, through the second openings 124, and into another portion of the annulus 126.

The outer housing 130 may have one or more third openings 132 formed radially-therethrough. The third openings 132 may be axially-offset from the second openings 124. As shown, the third openings 132 may be positioned below or downhole from the second openings 124. A path of fluid communication may exist from a portion of the annulus 126, through the third openings 132, and to an exterior of the downhole tool 100.

One or more annular sleeves (four are shown: 140, 150, 160, 170) may be positioned within the body 110. More particularly, a first sleeve 140 may be positioned in a portion of the annulus 126. Seals 118C, 118D may be positioned radially-between the inner housing 120 and the first sleeve 140 and on opposing axial sides of the first openings 122 in the inner housing 120, when the tool 100 is in the first, run-in state, as shown in FIG. 1. This may be a "first position" of the first sleeve 140, with the first sleeve 140 covering the first openings 122. The first sleeve 140 may be secured in place with one or more shear mechanisms 142. The shear mechanism 142 may be a pin, screw, bolt, ring, wire, or the like that is configured to break when exposed to a shearing force, allowing the first sleeve 140 to move axially within the annulus 126.

A second sleeve 150 may also be positioned in a portion of the annulus 126. The second sleeve 150 may be positioned below or downhole from the first sleeve 140. In at least one embodiment, the second sleeve 150 may be coupled to or integral with the first sleeve 140 (e.g., thus forming a single sleeve, with the second sleeve 150 serving as an extension of the first sleeve 140). The second sleeve 150 may have a plurality of teeth 154 coupled thereto or integral therewith. The plurality of teeth 154 may be acme threads, tapered in one direction to provide for a one-way engagement or "ratchet" functionality that prevents reverse movement, as will be further described below. In other embodiments, the teeth 154 may form a wicker-lock arrangement, which may also provide for such one-way engagement. The teeth 154 may be on an inner radial surface of the second sleeve 150.

A third sleeve 160 may also be positioned in a portion of the annulus 126. The third sleeve 160 may be positioned below or downhole from the second sleeve 150. The third sleeve 160 may be axially-aligned with the second openings 124 in the inner housing 120 when the downhole tool 100 is in the first, run-in state, as shown in FIG. 1. This may be a "first position" of the third sleeve 160. Seals 118E, 118F may be positioned radially-between the inner housing 120 and the third sleeve 160 and on opposing axial sides of the second openings 124. As such, the third sleeve 160 (and the seals 118E, 118F) may prevent fluid from flowing from the bore 112, through the second openings 124, and into the annulus 126 when the downhole tool 100 is in the first, run-in state. The seals 118E, 118F acting on the third sleeve 160 may be on the same diameter resulting in a balanced sleeve 160, or the seals 118E, 118F may be on different diameters, resulting in an unbalanced sleeve 160.

The third sleeve 160 may also have a plurality of teeth 164 coupled thereto or integral therewith. The teeth 164 may be configured to interact with the teeth 154 of the second sleeve 150, so as to provide for the one-way engagement therebetween. The one-way engagement of the teeth 154, 164 may allow the second sleeve 150 to move in a first axial direction (e.g., the downhole direction 104) relative to the third sleeve 160, but may prevent relative movement therebetween in the reverse axial direction (e.g., the uphole direction 102).

A fourth sleeve (also referred to as "main sleeve") 170 may also be positioned in a portion of the annulus 126. The fourth sleeve 170 may also be positioned at least partially between the outer housing 130 and the lower sub 116. The fourth sleeve 170 may be positioned below or downhole from the third sleeve 160. The fourth sleeve 170 may be axially-aligned with the third openings 132 in the outer housing 130 when the downhole tool 100 is in the first, run-in state.

A seal 118G may be positioned radially-between the inner housing 120 and the fourth sleeve 170, and another seal 118H may be positioned radially-between the lower sub 116 and the fourth sleeve 170. The seals 118G, 118H may be positioned on opposing axial sides of the third openings 132. Another seal 118I may be positioned radially-between the fourth sleeve 170 and the outer housing 130, and yet another seal 118J may be positioned radially-between the fourth sleeve 170 and the lower sub 116. The seals 118I, 118J may be positioned on opposing axial sides of the third openings 132. As such, the fourth sleeve 170 (and the seals 118G-J) may prevent fluid from flowing from the annulus 126, through the third openings 132, and to the exterior of the downhole tool 100 when the downhole tool 100 is in the first, run-in state.

The fourth sleeve 170 may be secured in place by one or more shear mechanisms 172. The shear mechanism 172 may be a pin, screw, bolt, or the like that is configured to break when exposed to a shearing force, allowing the fourth sleeve 170 to move axially within the annulus 126.

A biasing member 180 may also be positioned in a portion of the annulus 126 between the inner housing 120 and the outer housing 130. More particularly, the biasing member 180 may be positioned axially-between the first and third sleeves 140, 160. The biasing member 180 may at least partially axially-overlap the second sleeve 150. For example, at least a portion of the second sleeve 150 may be positioned radially-outward from the biasing member 180. As described in greater detail below, at least when the downhole tool 100 is in the second state, the biasing member 180 may exert a force on the first sleeve 140 and/or the second sleeve 150 in an uphole direction 102 to bias the first sleeve 140 and/or the second sleeve 150 in the uphole direction 102 (e.g., into the positions shown in FIGS. 1, 5, 6). The biasing member 180 may be a spring, a Bellville washer, or the like.

A drive ring 182 may also be positioned in at least a portion of the annulus 126. As shown, the drive ring 182 may be positioned axially-between the first sleeve 140 and the biasing member 180 and radially-inward from the second sleeve 150. The drive ring 182 may be spaced axially-apart from the first sleeve 140 when the downhole tool 100 is in the first, run-in state, as shown in FIG. 1. For example, the drive ring 182 may include a shoulder on an inner radial surface thereof that engages a corresponding shoulder or pin on an outer radial surface of the inner housing 120 that prevents the drive ring 182 from moving further in the uphole direction 102.

A stop ring 184 may also be positioned in at least a portion of the annulus 126. As shown, the stop ring 184 may be positioned axially-between the biasing member 180 and the third sleeve 160 and radially-inward from the second sleeve 150. The stop ring 184 may be secured axially in place. As described in greater detail below, when the drive ring 182 moves in the downhole direction 104, the biasing member 180 may be compressed between the drive ring 182 and the stop ring 184.

The first sleeve 140, the second sleeve 150, the third sleeve 160, the biasing member 180, the drive ring 182, or a combination thereof may function as a linear actuator. The linear actuator may be positioned at least partially around and/or between the upper sub 114, the lower sub 116, or a combination thereof. As described in greater detail below, the linear actuator may actuate from a first state (FIG. 1) to a second state (FIG. 3) in response to the pressure of the fluid in the bore 112 being increased to a first level. The linear actuator may then actuate into a third state (FIG. 4) in response the pressure of the fluid in the bore 112 decreasing from the first level to a second level that is less than the first level. The fourth sleeve 170 may prevent fluid flow through the third openings 132 when the linear actuator 190 is in the first state, the second state, and/or the third state. The linear actuator may then actuate into a fourth state (FIG. 5) in response to the pressure of the fluid in the bore 112 bleeding down from the first level the second level or increasing from the second level to a third level. When the linear actuator is in the fourth state, the fourth sleeve 170 may be axially-offset from the third openings 132 such that a path of fluid communication exists from the bore 112 into the annulus 126 (e.g., through the second openings 124), and from the annulus 126 to the exterior of the downhole tool 100 (e.g., through the third openings 132). The linear actuator moves in a linear/axial direction. In at least some embodiments, the linear actuator may thus actuate without relying on, and may potentially restrain, rotational movement of its component parts. The linear actuator does not rotate as it moves.

Figure 2:
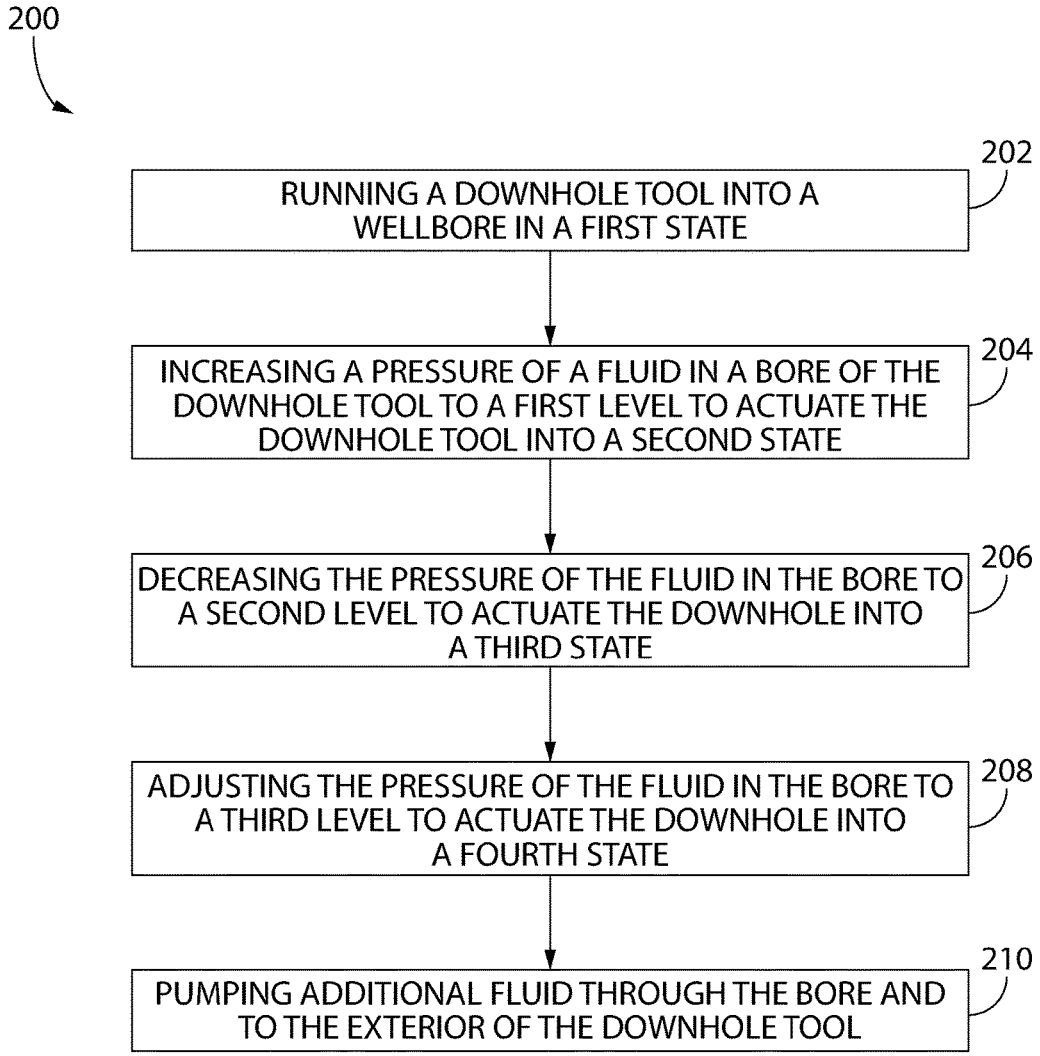
FIG. 2 illustrates a flowchart of a method for actuating the downhole tool, according to an embodiment.

FIG. 2 illustrates a flowchart of a method 200 for actuating the downhole tool 100, according to an embodiment. The method 200 is shown and described with respect to FIGS. 1 and 3-6. The method 200 may include running the downhole tool 100 into a wellbore in a first, run-in state, as at 202. As noted above, the downhole tool 100 is shown in the first, run-in state in FIG. 1. In at least one embodiment, the downhole tool 100 may be run into the wellbore until it is located proximate to the end of a horizontal or deviated portion of the wellbore (i.e., the toe of the wellbore). When the downhole tool 100 is in the first, run-in state, the fourth sleeve 170 may be in its first position covering the third opening 132. As such, the downhole tool 100 may be "closed" such that fluid communication is not permitted radially-through the downhole tool 100.

Figure 3:
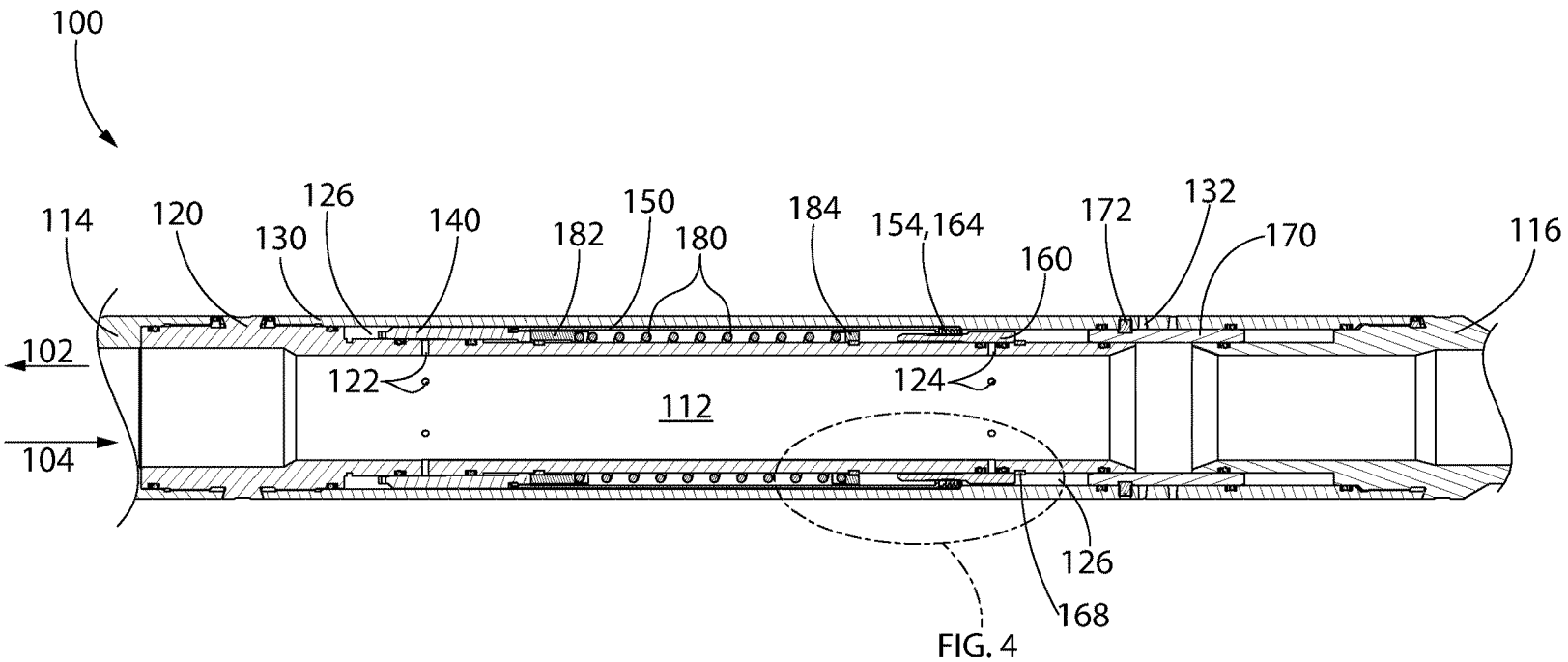
FIG. 3 illustrates a cross-sectional side view of the downhole tool in a second state, according to an embodiment.
Figure 4:
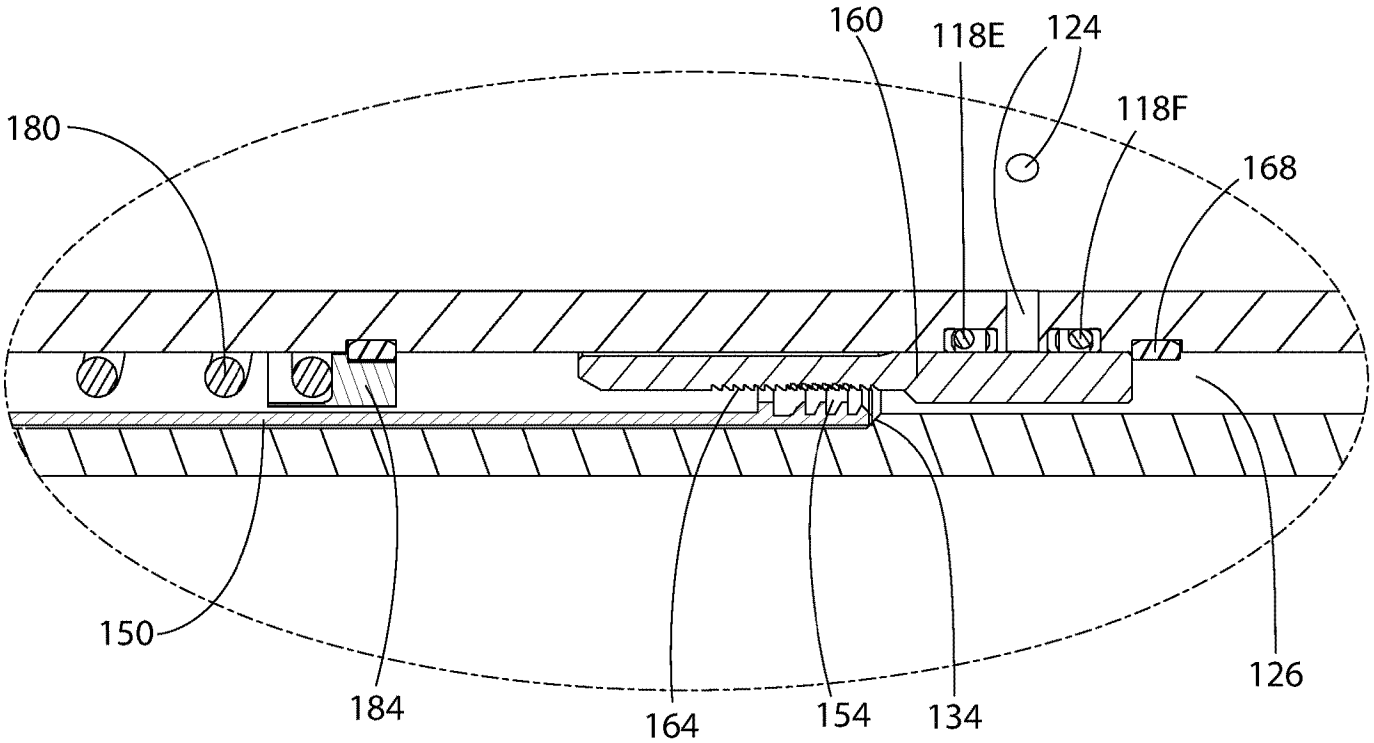
FIG. 4 illustrates an enlarged cross-sectional view of a portion of the downhole tool in the second state, according to an embodiment.

Once located in the desired position in the wellbore, the downhole tool 100 may be actuated into a second state. The downhole tool 100 remains closed in the second state. FIG. 3 illustrates a cross-sectional side view of the downhole tool 100 in the second state, and FIG. 4 illustrates an enlarged cross-sectional view of a portion of the downhole tool 100 in the second state, according to an embodiment.

To actuate the downhole tool 100 into the second state, the method 200 may include increasing a pressure of the fluid in the bore 112 of the downhole tool 100 (e.g., using a pump located at the surface) to a first level, as at 204. The pressure may be increased to, for example, test the integrity of a casing in the wellbore. The pressure of the fluid in the bore 112 may be communicated through the first openings 122 and into the annulus 126.

The pressure of the fluid in the annulus 126 may generate a force that is exerted on the first sleeve 140 in the downhole direction 104 (e.g., to the right, as shown in FIG. 3). More particularly, the force may be exerted on a piston surface 144 of the first sleeve 140. The piston surface 144 may be a radial surface that extends from a first inner diameter portion of the first sleeve 140 to a second inner diameter portion of the first sleeve 140. The first inner diameter portion may be larger than and positioned above the second inner diameter portion. When the force on the piston surface 144 of the first sleeve 140 exceeds a predetermined amount, the shear mechanism(s) 142 holding the first sleeve 140 in place may shear or break, allowing the first sleeve 140 to move in the downhole direction 104, e.g., moving the first sleeve 140 out of the first position and toward the third sleeve 160.

In an alternative embodiment, instead of or in addition to the shear mechanism(s) 142, the first openings 122 may have burst or rupture discs positioned therein that prevent fluid flow through the first openings 122. The burst discs may burst when the pressure of the fluid in the bore 112 reaches or exceeds the first level, thereby providing a path of fluid communication from the bore 112, through the first openings 122, and into the annulus 126, where the pressurized fluid may exert a force on the first sleeve 140 that moves the first sleeve 140 in the downhole direction 104. In other embodiments, instead of or in addition to burst discs, the first openings 122 may include valves, sliding sleeves, or the like to selectively allow fluid flow through the first openings 122.

Once the shear mechanism(s) 142 (or rupture disks, etc.) break, the first sleeve 140 and the second sleeve 150 may move in the downhole direction 104 until the first sleeve 140 contacts the drive ring 182. The first sleeve 140 may exert a force on the drive ring 182 in the downhole direction 104 that causes the first sleeve 140, the second sleeve 150, and the drive ring 182 to move together in the downhole direction 104. The drive ring 182 may compress the biasing member 180 as the drive ring 182 moves in the downhole direction 104. The first sleeve 140, the second sleeve 150, and the drive ring 182 may move together in the downhole direction 104 until the second sleeve 150 contacts a shoulder 134 (see FIG. 4) on the inner surface of the outer housing 130, as shown in FIGS. 3 and 4.

As the second sleeve 150 moves with respect to the third sleeve 160, the teeth 154 on the second sleeve 150 may become axially-aligned with and engage the teeth 164 of the third sleeve 160. This engagement may allow the second sleeve 150 to move in the downhole direction 104 with respect to the third sleeve 160 (until the second sleeve 150 contacts the shoulder 134); however, the engagement may prevent the second sleeve 150 from moving in the uphole direction 102 unless the third sleeve 160 also moves in the uphole direction 102, thereby moving the third sleeve 160 out of its first position. The third sleeve 160 may be prevented from moving in the downhole direction 104 by one or more pins 168 extending radially from the inner housing 120. In another embodiment, the third sleeve 160 may be prevented from moving in the downhole direction 104 by a shoulder of the inner housing 120.

Figure 5:
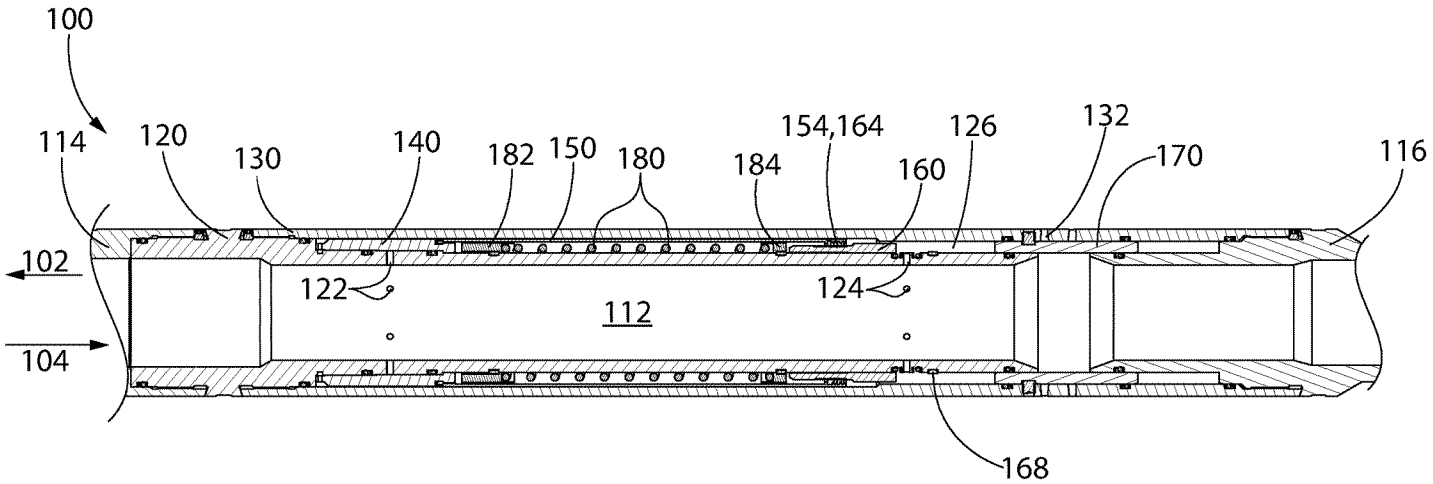
FIG. 5 illustrates a cross-sectional side view of the downhole tool in a third state, according to an embodiment.

Once the pressure testing is complete, and the teeth 154 of the second sleeve 150 are engaged with the teeth 164 of the third sleeve 160, the downhole tool 100 may be actuated into a third state. The downhole tool 100 remains closed in the third state. FIG. 5 illustrates a cross-sectional side view of the downhole tool 100 in the third state, according to an embodiment. To actuate the downhole tool 100 into the third state, the method 200 may include decreasing (i.e., "bleeding down") the pressure of the fluid in the bore 112 to a second level that is less than the first level (e.g., using the pump at the surface), as at 206.

As the pressure of the fluid in the annulus 126 decreases from the first level to the second level, the force exerted on the first sleeve 140, the second sleeve 150, and the drive ring 182 by the pressurized fluid in the downhole direction 104 may eventually be overcome by the force exerted by the biasing member 180 in the uphole direction 102. When this occurs, the first sleeve 140, the second sleeve 150, the drive ring 182, and the third sleeve 160 may move in the uphole direction 102, as shown in FIG. 5. The third sleeve 160 may move in the uphole direction 102 due to the engagement with the second sleeve 150. As such, the third sleeve 160 may become at least partially axially-offset from the second openings 124, allowing fluid communication from the bore 112, through the second openings 124, and into the portion of the annulus 126 between the third and fourth sleeves 160, 170.

Figure 6:
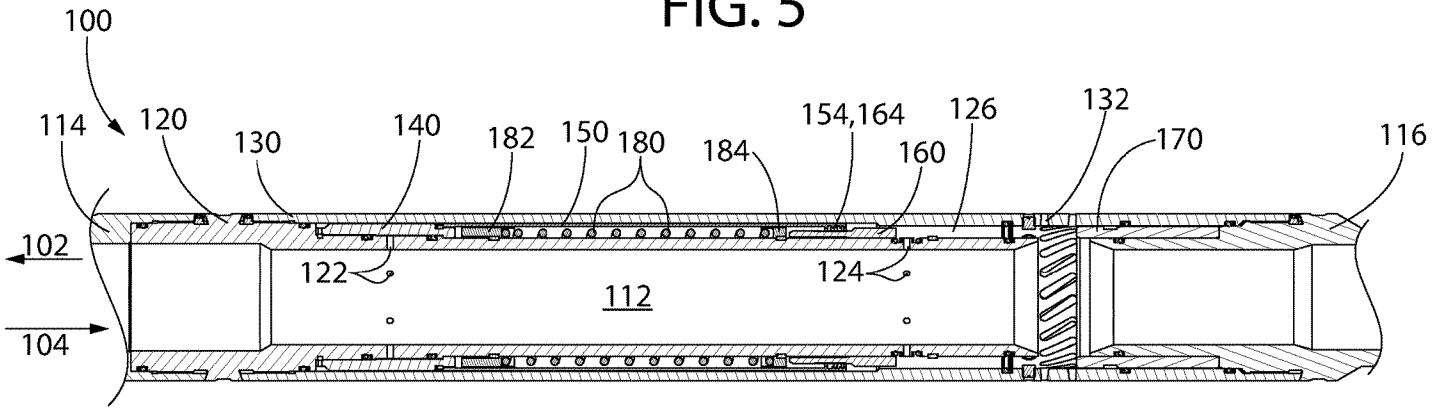
FIG. 6 illustrates a cross-sectional side view of the downhole tool in a fourth state where a path of fluid communication exists between an interior bore of the downhole tool and an exterior of the downhole tool, according to an embodiment.

The pressure of the fluid in the bore 112 may be communicated through the second openings 124 and into the portion of the annulus 126 between the third and fourth sleeves 160, 170 where the pressure exerts a force on the fourth sleeve 170 in the downhole direction 104. The method 200 may also include adjusting the pressure of the fluid in the bore 112 of the downhole tool 100 to a third level (e.g., using the pump at the surface) to actuate the downhole tool 100 into the fourth state, as at 208. FIG. 6 illustrates a cross-sectional side view of the downhole tool 100 in the fourth state, according to an embodiment. The downhole tool 100 is open in the fourth state such that fluid communication is permitted radially-through the downhole tool 100.

In at least one embodiment, adjusting the pressure may include decreasing (i.e., "bleeding down") the pressure of the fluid in the bore 112 from the second level to the third level. As the pressure is decreased, the pressure may still generate a force that is exerted on the fourth sleeve 170 in the downhole direction 104. This force may cause the shear mechanism(s) 172 securing the fourth sleeve 170 in place to shear or break, allowing the fourth sleeve 170 to move from a first position (FIGS. 1, 3, 4, 5) to a second position (FIG. 6). This may actuate the downhole tool 100 into the fourth state.

If the force exerted on the fourth sleeve 170 is insufficient to break the shear mechanism(s) 172 as the pressure decreases, adjusting the pressure (at 208) may include increasing the pressure of the fluid in the bore 112 of the downhole tool 100 to the third pressure level. In this embodiment, the third pressure level may be greater than the second pressure level but less than the first pressure level so as to not cause the third sleeve 160 to move back in the downhole direction 104 and seal the second openings 124. When the pressure of the fluid is at the third level, the force exerted on the fourth sleeve 170 in the downhole direction 104 may exceed the predetermined amount, causing the shear mechanism(s) 172 holding the fourth sleeve 170 in place to shear or break, allowing the fourth sleeve 170 to move in the downhole direction 104 from the first position (FIGS. 1, 3, 4, 5) to the second position (FIG. 6), thereby actuating the downhole tool 100 into the fourth state.

When the fourth sleeve 170 is axially-offset from the third openings 132, as shown in FIG. 6, a path of fluid communication may exist from the bore 112 to the portion of the annulus 126 between the third and fourth sleeves 160, 170 (e.g., through the second openings 124), and from the portion of the annulus 126 between the third and fourth sleeves 160, 170 to the exterior of the downhole tool 100 (e.g., through the third openings 132).

The method 200 may then include pumping additional fluid through the bore 112 to the portion of the annulus 126 between the third and fourth sleeves 160, 170 (e.g., through the second openings 124), and from the portion of the annulus 126 between the third and fourth sleeves 160, 170 to the exterior of the downhole tool 100 (e.g., through the third openings 132), as at 210. This additional fluid may be used for circulation in the wellbore and/or to commence fracking operations in the wellbore.

Figure 7:
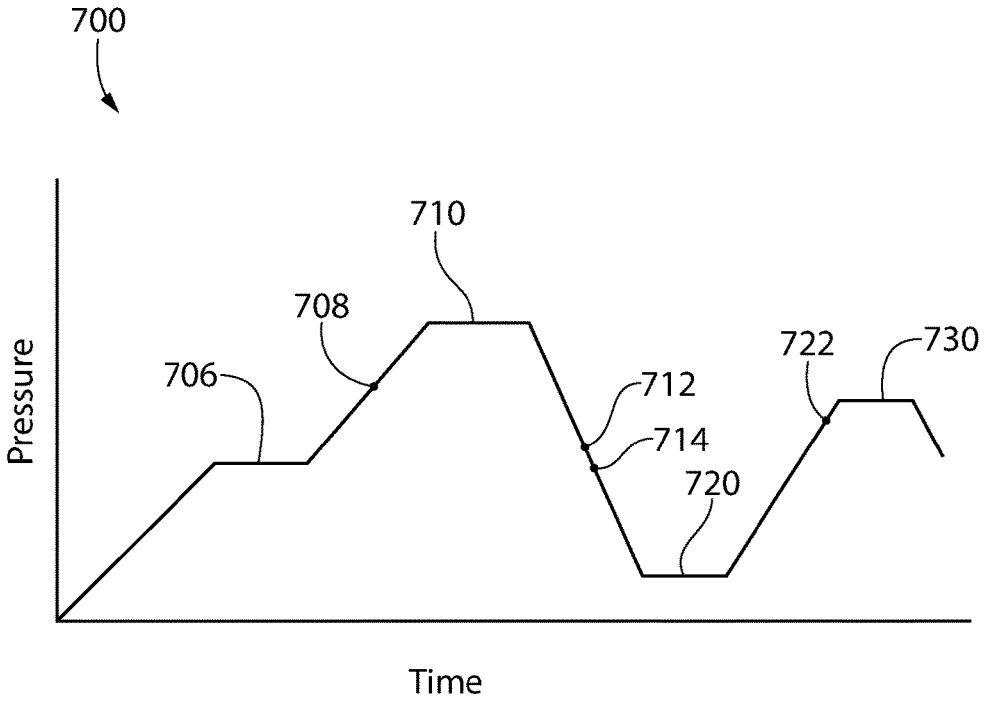
FIG. 7 illustrates a graph showing the pressure levels that cause the downhole tool to actuate between the various states, according to an embodiment.

FIG. 7 illustrates a graph 700 showing the pressure levels that cause the downhole tool 100 to actuate between the various states, according to an embodiment. The pressure of the fluid in the bore 112 may be increased to the first level 710. The downhole tool 100 may actuate from the first state to the second state at a pressure 708 that is less than or equal to the first level 710.

The pressure of the fluid in the bore 112 may then be decreased from the first level 710 to the second level 720. The downhole tool 100 may actuate from the second state to the third state at a pressure 712 that is less than the first level 710 and greater than or equal to the second level 720. The pressure 712 at which the downhole tool 100 actuates from the second state to the third state may be less than or equal to the pressure 708 at which the downhole tool 100 actuates from the first state to the second state.

In at least one embodiment, the downhole tool 100 may actuate from the third state to the fourth state at a pressure 714 during the bleed down from the first level 710 to the second level 720. This may occur when the pressure 714 exerts a force on the sleeve 170 that is great enough to cause the shear mechanism(s) 172 to break. The pressure 714 may be less than the pressure 712 at which the downhole tool 100 actuated into the third state and greater than or equal to the second level 720. In another embodiment, when the pressure 714 does not exert a force on the sleeve 170 that is great enough to cause the shear mechanism(s) 172 to break, the downhole tool 100 may not actuate from the third state to the fourth state at a pressure that is less than the pressure 712 at which the downhole tool 100 actuated into the third state. Rather, the pressure of the fluid in the bore 112 may subsequently be increased from the second level 720 to a third level 730. In this embodiment, the downhole tool 100 may actuate from the third state to the fourth state at a pressure 722 that is greater than or equal to the pressure 712 at which the downhole tool 100 actuated into the third state and less than or equal to the third level 730. The pressure 722 may exert a force on the sleeve 170 that is great enough to cause the shear mechanism(s) 172 to break.

An initial casing and surface test may be performed at a pressure 706 as the pressure is being increased to the first level 710. At the first level, a planned casing test may be performed.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An actuator for a downhole tool, the actuator comprising:

a first sleeve that obstructs a first port in a body of the downhole tool when the first sleeve is in a first position;

a second sleeve that is movable with the first sleeve and extends axially therefrom;

a third sleeve that obstructs a second port in the body when the third sleeve is in a first position, the second and third sleeves being in one-way engagement with one another; and a biasing member positioned between the first sleeve and the third sleeve, such that movement of the first sleeve toward the third sleeve compresses the biasing member, wherein the first sleeve is configured to move from the first position and toward the third sleeve in response a pressure communicated through the first port, and wherein when the pressure is reduced after the first sleeve is moved toward the third sleeve, the biasing member forces the first sleeve back toward the first position, which causes the third sleeve to permit fluid communication through the second port.

2. The actuator of claim 1, wherein the first and second sleeves are coupled together or integral with one another.

3. The actuator of claim 1, wherein the second sleeve comprises a first set of teeth, and the third sleeve comprises a second set of teeth that is configured to engage the first set of teeth, and wherein the first and second sets of teeth provide the one-way engagement when the first and second sets of teeth are engaged with one another.

4. The actuator of claim 3, wherein the first set of teeth is positioned on an inner radial surface of the second sleeve, and wherein the second set of teeth is positioned on an outer radial surface of the third sleeve.

5. The actuator of claim 1, further comprising:

a drive ring positioned axially-between the first sleeve and the biasing member, wherein the drive ring is configured to move together with the first sleeve to compress the biasing member; and an anchor ring positioned axially between the biasing member and the third sleeve, wherein the anchor ring is coupled to the body.

6. The actuator of claim 5, wherein the drive ring is initially spaced axially-apart from the first sleeve, and wherein the drive ring moves together with the first sleeve in response the pressure communicated through the first port.

7. The actuator of claim 1, further comprising a shearing mechanism configured to hold the first sleeve in the first position until the pressure communicated through the first port reaches or exceeds a predetermined level.

8. The actuator of claim 1, wherein a diameter of an inner radial surface of the first sleeve varies, defining a piston surface on which the pressure exerts a force to move the first sleeve toward the third sleeve.

9. A downhole tool, comprising:

an inner housing having a bore extending axially-therethrough, a first opening extending radially-therethrough, and a second opening extending radially-therethrough, wherein the first and second openings are axially-offset from one another;

an outer housing positioned radially-outward from the inner housing such that an annulus is disposed between the inner and outer housings, wherein the outer housing has a third opening extending radially-therethrough;

a first sleeve positioned in the annulus;

a second sleeve positioned in the annulus, wherein the second sleeve is movable with the first sleeve and extends axially therefrom;

a third sleeve positioned in the annulus and axially-offset from the first sleeve, the third sleeve preventing fluid flow through the second opening when the third sleeve is in a first position; and a fourth sleeve positioned in the annulus and axially-offset from the third sleeve, the fourth sleeve preventing fluid flow through the third opening when the fourth sleeve is in a first position, wherein the first and second sleeves move together within the annulus such that the second sleeve engages the third sleeve when a pressure of a fluid in the bore is increased to a first level, wherein the first, second, and third sleeves move together such that the third sleeve moves into a second position that allows fluid flow through the second opening when the pressure of the fluid in the bore is decreased to a second level, and wherein the fourth sleeve moves into a second position that allows fluid flow through the third opening as the pressure of the fluid in the bore is decreasing from the first level to the second level or when the pressure of the fluid in the bore is increased from the second level to a third level.

10. The downhole tool of claim 9, wherein the third level of pressure is less than the first level of pressure.

11. The downhole tool of claim 9, further comprising a shear mechanism configured to secure the first sleeve in place, wherein the pressure of the fluid is communicated through the first opening and exerts a force on a piston surface of the first sleeve that causes the shear mechanism to break when the pressure of the fluid is increased to the first level.

12. The downhole tool of claim 9, further comprising a drive ring positioned in the annulus and spaced axially-apart from the first sleeve before the pressure of the fluid is increased to the first level, and wherein the first sleeve contacts the drive ring such that the first sleeve and the drive sleeve move together in response to the pressure of the fluid being increased to the first level.

13. The downhole tool of claim 12, further comprising a biasing member positioned in the annulus, wherein the drive ring compresses the biasing member when the drive ring moves in response to the pressure of the fluid being increased to the first level.

14. The downhole tool of claim 13, further comprising a stop ring positioned in the annulus, wherein the stop ring remains stationary with respect to the inner housing as the biasing member is compressed between the drive ring and the stop ring.

15. The downhole tool of claim 13, wherein, in response to the pressure of the fluid being increased to the first level, the fluid exerts a force on the first sleeve and the drive ring that is greater than an opposing force exerted on the first sleeve and the drive ring by the biasing member, causing the first sleeve and the drive ring to move within the annulus, thereby compressing the biasing member.

16. The downhole tool of claim 15, wherein the force exerted on the first sleeve and the drive ring by the fluid is less than the opposing force exerted on the first sleeve and the drive ring by the biasing member when the pressure of the fluid is at the second level, the third level, or both.

17. The downhole tool of claim 9, wherein an inner radial surface of the outer housing defines a shoulder, and wherein the second sleeve contacts the shoulder when the pressure of the fluid in the bore is increased to the first level, preventing further movement of the second sleeve in a downhole direction.

18. The downhole tool of claim 9, wherein an inner radial surface of the second sleeve comprises a first set of teeth, wherein an outer radial surface of the third sleeve comprises a second set of teeth, and wherein the second sleeve moves with respect to the third sleeve such that the first and second sets of teeth engage one another in response to the pressure of the fluid being increased to the first level.

19. The downhole tool of claim 9, further comprising a shear mechanism configured to secure the fourth sleeve in place, wherein the pressure of the fluid is communicated through the second opening and exerts a force on the fourth sleeve that causes the shear mechanism to break when the pressure of the fluid in the bore decreases from the first level to the second level or when the pressure of the fluid in the bore increases from the second level to the third level.

20. A method for operating a downhole tool, comprising:

running the downhole tool into a wellbore, wherein the downhole tool defines:

a bore extending axially-therethrough;

an annulus positioned radially-outward from the bore;

a first opening that provides a path of fluid communication radially-between the bore and the annulus;

a second opening that provides a path of fluid communication radially-between the bore and the annulus, wherein the first and second openings are axially-offset from one another; and a third opening that provides a path of communication from the annulus to an exterior of the downhole tool;

increasing a pressure of a fluid in the bore to a first level, wherein the first level of pressure is communicated through the first opening and exerts a force on a first sleeve in the annulus that causes the first sleeve and a second sleeve to move from a first position to a second position; and decreasing the pressure of the fluid in the bore to a second level after the first and second sleeves move to the second position, thereby causing a third sleeve in the annulus to move from a first position where the third sleeve prevents fluid flow through the second opening to a second position where the third sleeve allows fluid flow through the second opening.

21. The method of claim 20, wherein, as the pressure of the fluid in the bore decreases from the first level to the second level, a fourth sleeve in the annulus moves from a first position where the fourth sleeve prevents fluid flow through the third opening to a second position where the fourth sleeve allows fluid flow through the third opening.

22. The method of claim 20, further comprising increasing the pressure of the fluid in the bore to a third level after the third sleeve moves to the second position, thereby causing a fourth sleeve in the annulus to move from a first position where the fourth sleeve prevents fluid flow through the third opening to a second position where the fourth sleeve allows fluid flow through the third opening.

23. The method of claim 22, further comprising pumping additional fluid into the bore after the fourth sleeve moves into the second position, wherein the additional fluid flows from the bore, through the second opening and into the annulus, and through the third opening and to an exterior of the downhole tool.

24. A method for operating a downhole tool, comprising:

positioning a downhole tool in a first state into a wellbore, wherein the downhole tool is closed in the first state such that fluid communication is not permitted radially-through the downhole tool;

increasing a pressure of a fluid in a bore of the downhole tool to a first level, wherein increasing the pressure to the first level causes the downhole tool to actuate from the first state to a second state, wherein the downhole tool remains closed in the second state;

decreasing the pressure of the fluid in the bore to a second level after increasing the pressure to the first level, wherein decreasing the pressure to the second level causes the downhole tool to actuate from the second state to a third state, wherein the downhole tool remains closed in the third state; and adjusting the pressure of the fluid in the bore to a third level after decreasing the pressure to the second level, wherein adjusting the pressure to the third level causes the downhole tool to actuate from the third state to a fourth state, wherein the downhole tool is open in the fourth state, such that fluid communication radially through the downhole tool is permitted, wherein adjusting the pressure comprises continuing to decrease the pressure from the second level to the third level.

25. The method of claim 24, wherein the first level of pressure is communicated through a first opening in the downhole tool and exerts a force on a first sleeve in the downhole tool that causes the first sleeve and a second sleeve to move from a first position to a second position.

26. The method of claim 25, wherein, in response to the pressure being decreased to the second level, a third sleeve in the downhole tool moves from a first position where the third sleeve prevents fluid flow through a second opening in the downhole tool to a second position where the third sleeve allows fluid flow through the second opening.

27. The method of claim 26, wherein, in response to the pressure being adjusted to the third level, a fourth sleeve in the downhole tool moves from a first position where the fourth sleeve prevents fluid flow through a third opening in the downhole tool to a second position where the fourth sleeve allows fluid flow through the third opening.

28. A method for operating a downhole tool, comprising:

positioning a downhole tool in a first state into a wellbore, wherein the downhole tool is closed in the first state such that fluid communication is not permitted radially-through the downhole tool;

increasing a pressure of a fluid in a bore of the downhole tool to a first level, wherein increasing the pressure to the first level causes the downhole tool to actuate from the first state to a second state, wherein the downhole tool remains closed in the second state;

decreasing the pressure of the fluid in the bore to a second level after increasing the pressure to the first level, wherein decreasing the pressure to the second level causes the downhole tool to actuate from the second state to a third state, wherein the downhole tool remains closed in the third state; and adjusting the pressure of the fluid in the bore to a third level after decreasing the pressure to the second level, wherein adjusting the pressure to the third level causes the downhole tool to actuate from the third state to a fourth state, wherein the downhole tool is open in the fourth state, such that fluid communication radially through the downhole tool is permitted, wherein adjusting the pressure comprises increasing the pressure to the third level after decreasing the pressure to the second level.

* * * * *